US006667238B1

(12) United States Patent
Kimura et al.

(10) Patent No.: US 6,667,238 B1
(45) Date of Patent: Dec. 23, 2003

(54) POLISHING METHOD AND APPARATUS

(75) Inventors: Norio Kimura, Fujisawa (JP); Mitsuhiko Shirakashi, Fujisawa (JP); Katsuhiko Tokushige, Sagamihara (JP); Masao Asami, Kawasaki (JP); Naoto Miyashita, Yokohama (JP); Masako Kodera, Yokohama (JP); Yoshitaka Matsui, Yokohama (JP); Soichi Nadahara, Yokohama (JP); Hiroshi Tomita, Yokohama (JP)

(73) Assignees: Ebara Corporation, Tokyo (JP); Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/545,504

(22) Filed: Apr. 7, 2000

(30) Foreign Application Priority Data

Apr. 8, 1999 (JP) ..... 11-101125

(51) Int. Cl.[7] ..... H01L 21/00

(52) U.S. Cl. ..... 438/692; 156/345.12; 216/38; 216/88; 438/745

(58) Field of Search ..... 438/692, 693, 438/745, 754; 134/1.3; 216/38, 88, 89, 100, 105, 91; 156/345.12

(56) References Cited

U.S. PATENT DOCUMENTS

| | | | | |
|---|---|---|---|---|
| 5,635,053 A | * | 6/1997 | Aoki et al. | 205/746 |
| 5,676,760 A | * | 10/1997 | Aoki et al. | 134/1.3 |
| 5,922,620 A | * | 7/1999 | Shimomura et al. | 438/693 |
| 5,931,722 A | | 8/1999 | Ohmi et al. | |
| 5,996,594 A | * | 12/1999 | Roy et al. | 134/1.3 |
| 6,003,527 A | * | 12/1999 | Netsu et al. | 134/1.3 |
| 6,071,816 A | * | 6/2000 | Watts et al. | 438/692 |
| 6,098,638 A | * | 8/2000 | Miyashita et al. | 134/1.3 |
| 6,325,698 B1 | * | 12/2001 | Wada et al. | 451/8 |

FOREIGN PATENT DOCUMENTS

| | | |
|---|---|---|
| EP | 0 806 265 A1 | 11/1997 |
| EP | 0 913 442 A2 | 5/1999 |
| GB | 2 324 750 | 11/1998 |
| JP | 62-74487 | 4/1987 |
| JP | 64-90088 | 4/1989 |
| JP | 3-136329 | 6/1991 |
| JP | 6-260480 | 9/1994 |
| JP | 10-99802 | 4/1998 |
| JP | 10-314686 | 12/1998 |

OTHER PUBLICATIONS

Takeshi Hattori et al., "Sixth International Symposium on Cleaning Technology in Semiconductor Device Manufacturing", The Electrochemical Society, Oct. 1999.

Toshiaki Kawane et al., "NEC Approach", Semiconductor World, Oct. 1998.

Takeshi Hattori et al., "Contamination Removal by Single–Wafer Spin Cleaning with Repetitive Use of Ozonized Water and Dilute HF", Sony Corporation Semiconductor Company, Japan, Sep. 1998.

Aoki et al., "A degradation–free Cu/HSQ damascene technology using metal mask patterning and post–CMP cleaning by electrolytic ionized water", Technical Digest, International Electron Devices Meeting (Dec. 7, 1997), pp. 31.4.1 through 31.4.4.*

* cited by examiner

*Primary Examiner*—William A. Powell
(74) *Attorney, Agent, or Firm*—Wenderoth, Lind & Ponack, L.L.P.

(57) ABSTRACT

A polishing apparatus is used for chemical mechanical polishing a copper (Cu) layer formed on a substrate such as a semiconductor wafer and then cleaning the polished substrate. The polishing apparatus has a polishing section having a turntable with a polishing surface and a top ring for holding a substrate and pressing the substrate against the polishing surface to polish a surface having a semiconductor device thereon, and a cleaning section for cleaning the substrate which has been polished. The cleaning section has an electrolyzed water supply device for supplying electrolyzed water to the substrate to clean the polished surface of the substrate while supplying electrolyzed water to the substrate.

13 Claims, 4 Drawing Sheets

POLISHING METHOD AND APPARATUS

BACKGROUND OF THE INVENTION

1. Field of the Invention

The present invention relates to a polishing method and apparatus, and more particularly to a polishing method and apparatus for chemical mechanical polishing a copper (Cu) layer formed on a substrate such as a semiconductor wafer and then cleaning the polished substrate.

2. Description of the Related Art

Conventionally, in order to form a wiring circuit on a semiconductor substrate, a conductive film is deposited over a surface of a substrate by a sputtering process or the like, and then unnecessary portions are removed from the conductive film by a chemical dry etching process using a photoresist for a mask pattern.

Generally, aluminum or aluminum alloy has been used as a material for forming a wiring circuit. However, the higher integration of integrated circuits on the semiconductor substrate in recent years requires the narrower wiring to thus increase the current density, resulting in generating thermal stress in the wiring and increasing the temperature of the wiring. This unfavorable condition becomes more significant, as wiring material such as aluminum is thinner due to stress-migration or electromigration, finally causing a breaking of wire or a short circuit.

Hence, in order to prevent the wiring from generating excess heat while current flows, a material such as copper having a higher electrical conductivity is required to be used for a wiring circuit. However, since copper or copper alloy is not suited for the dry etching process, it is difficult to adopt the above-mentioned method in which the wiring pattern is formed after depositing the conductive film over the whole surface of the substrate. Therefore, one of possible processes is that grooves for a wiring circuit having a predetermined pattern are formed, and then the grooves are filled with copper or copper alloy. This process eliminates the etching process of removing unnecessary portions of the film, and needs only a polishing process of removing unevenness or irregularities of the surface. Further, this process offers the advantages that portions called wiring holes connecting between an upper layer and a-lower layer in a multilayer circuit can be formed at the same time.

However, as the width of the wiring is narrower, such wiring grooves or wiring holes have a considerably higher aspect ratio (the ratio of depth to diameter or width), and hence it is difficult to fill the grooves or the holes with metal uniformly by the sputtering process. Further, although a chemical vapor deposition (CVD) process is used to deposit various materials, it is difficult to prepare an appropriate gas material for copper or copper alloy, and if an organic material is used for depositing copper or copper alloy, carbon (C) is mixed into a deposited film to increase migration of the film.

Therefore, there has been proposed a method in which a substrate is dipped in a plating solution to plate the substrate with copper by an electrolytic plating or an electroless plating and then an unnecessary portion of a copper layer is removed from the substrate by a chemical mechanical polishing (CMP) process. This formation of film or layer by the plating allows wiring grooves having a high aspect ratio to be uniformly filled with a metal having a high electrical conductivity. In the CMP process, a semiconductor wafer held by the top ring is pressed against a polishing cloth attached to a turntable, while supplying a polishing liquid containing abrasive particles, and thus the copper layer on the semiconductor wafer is polished.

Immediately after the copper layer is polished in the CMP process, a polished surface of the copper layer on the semiconductor wafer has a high activity so that the polished surface is liable to be oxidized. If the polished surface on the semiconductor wafer is left as it is, then an oxide film is formed by natural oxidation on the polished surface of the semiconductor wafer. However, such oxide film tends to be formed irregularly or nonuniformly because no control is not made of formation of the oxide film, and hence the formed oxide film is of poor quality. If the oxide film is left as it is, then oxidation of the polished surface of the semiconductor wafer is further being developed. Particularly, in the case where copper is used as a material for forming a wiring circuit of a semiconductor device, electrical characteristics are changed to produce products inferior in quality.

Further, during polishing, a polishing liquid or by-product generated by polishing reaches the back surface opposite to the polished surface of the semiconductor wafer and is attached thereto, and may possibly contaminate the atmosphere in a clean room.

SUMMARY OF THE INVENTION

It is therefore an object of the present invention to provide a polishing apparatus and method which can control the characteristics of a polished surface of copper layer on a substrate such as a semiconductor wafer and the characteristics of a back surface of the substrate which is an opposite side to the polished surface.

According to one aspect of the present invention, there is provided a polishing apparatus comprising a polishing section having a turntable with a polishing surface and a top ring for holding a substrate and pressing the substrate against the polishing surface to polish a surface having semiconductor device thereon. A cleaning section cleans the substrate which has been polished, the cleaning section having an electrolyzed water supply device for supplying electrolyzed water to the substrate to clean at least a polished surface of the substrate while supplying the electrolyzed water to the substrate. As an electrolyzed water, anode electrolyzed water is desirable. The turntable preferably comprises a ceramic turntable.

According to another aspect of the present invention, there is provided a polishing method comprising polishing a surface of a substrate by holding the substrate and pressing the substrate against a polishing surface of a turntable, the surface of the substrate having a semiconductor device thereon; and cleaning at least a polished surface of the substrate while supplying electrolyzed water to the substrate.

In a preferred embodiment, the electrolyzed water supply device supplies electrolyzed water to the front and back surfaces of the substrate. The polishing apparatus further comprises an ultrasonic transducer for applying ultrasonic vibrations to the electrolyzed water before supplying the electrolyzed water to the substrate.

The polishing apparatus further comprises a supply device for supplying diluted hydrofluoric acid to the substrate.

According to the present invention, the electrolyzed water supply device is provided at a plurality of locations from the polishing section to the cleaning section in the polishing apparatus.

According to the present invention, after the copper layer of the substrate having a semiconductor device is polished, the front surface (surface having the copper layer) and the back surface are cleaned by electrolyzed water such as anode electrolyzed water.

The electrolyzed water is obtained by electrolyzing pure water, or pure water to which electrolyte is added. The electrolyzed water is classified into anode electrolyzed water having a large oxidizing capability and cathode electrolyzed water having a large reducing capability. The anode electrolyzed water is preferably used for oxidizing the surface of the copper layer (film) on the substrate after polishing.

The above and other objects, features, and advantages of the present invention will be apparent from the following description, when taken in conjunction with the accompanying drawings, which illustrates preferred embodiments of the present invention by way of example.

DETAILED DESCRIPTION OF THE PREFERRED EMBODIMENTS

A polishing apparatus and method according to an embodiment of the present invention will be described below with reference to FIGS. 1 through 4.

Figure 1:
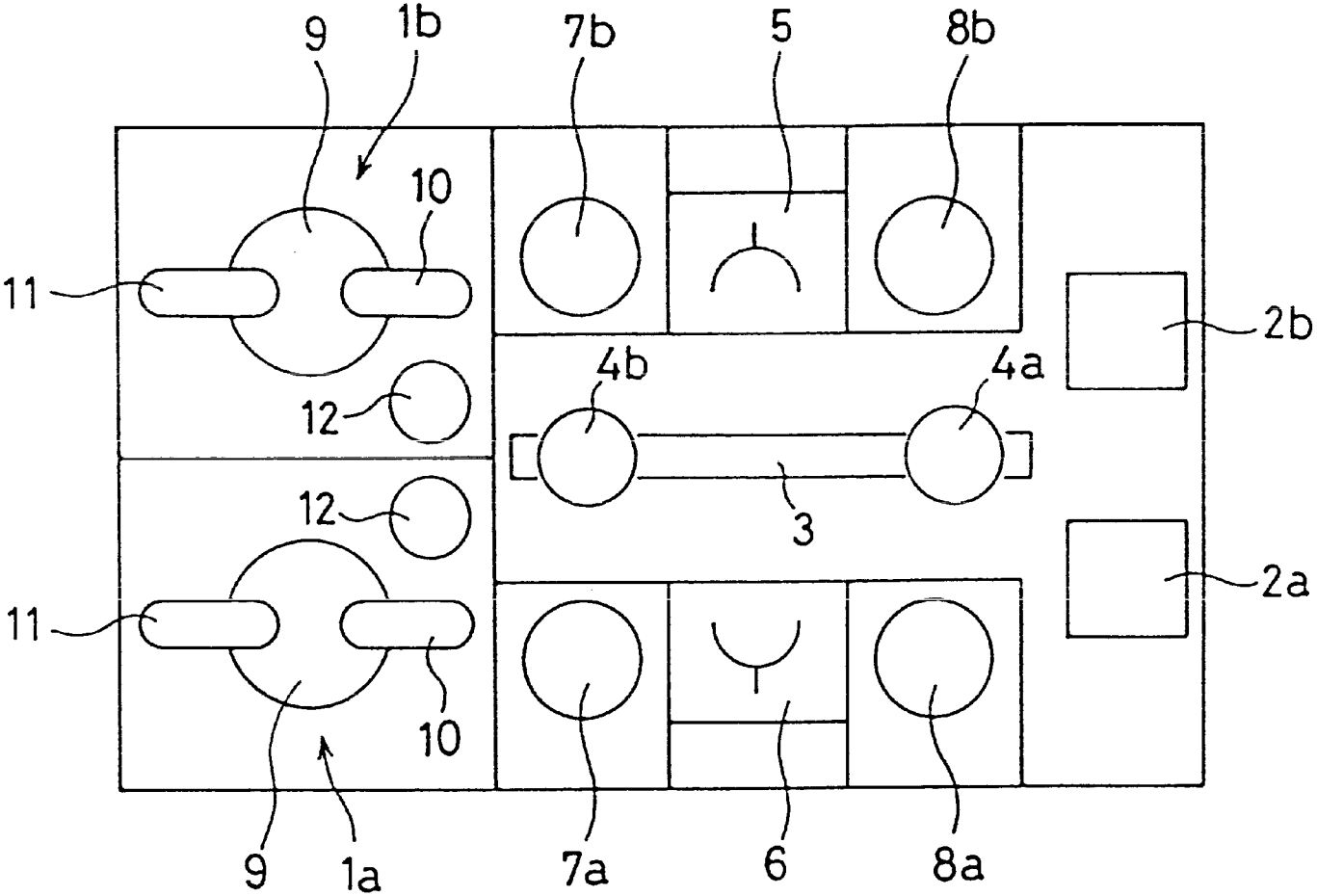
FIG. 1 is a schematic plan view of a polishing apparatus according to an embodiment of the present invention.
Figure 2:
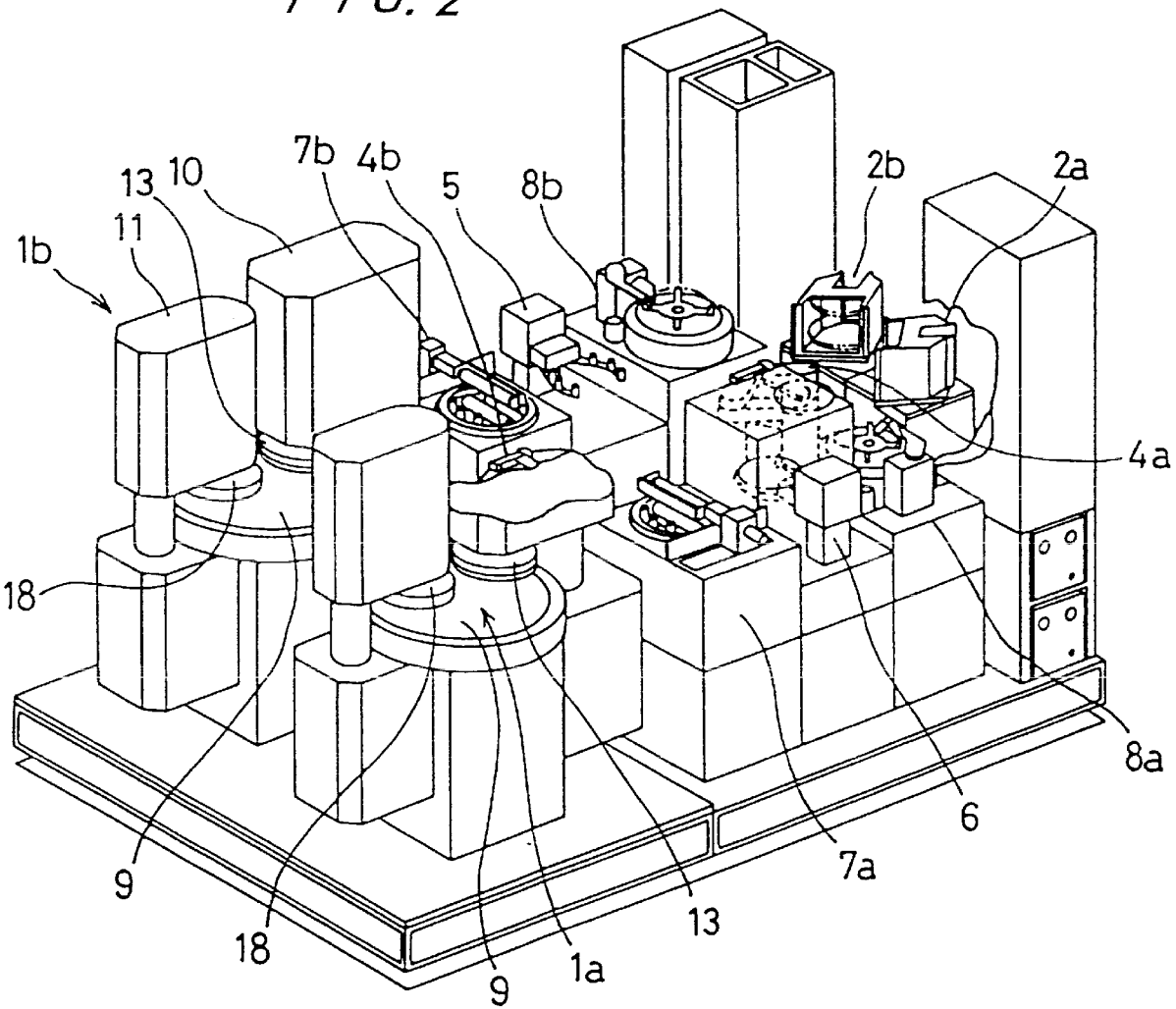
FIG. 2 is a perspective view of the polishing apparatus shown in FIG. 1.

As shown in FIGS. 1 and 2, a polishing apparatus comprises a pair of polishing units 1*a*, 1*b* positioned at one end of a rectangular floor space and spaced from each other in confronting relation to each other, and a pair of loading/unloading units positioned at the other end of the rectangular floor space and having respective wafer cassettes 2*a*, 2*b* spaced from the polishing units 1*a*, 1*b* in confronting relation thereto. Two transfer robots 4*a*, 4*b* are movably mounted on a rail 3 which extends between the polishing units 1*a*, 1*b* and the loading/unloading units, thereby providing a transfer line along the rail 3. The polishing apparatus also has a pair of reversing units 5, 6 disposed one on each side of the transfer line and two pairs of cleaning units 7*a*, 7*b* and 8*a*, 8*b* disposed one pair on each side of the transfer line. The reversing unit 5 is positioned between the cleaning units 7*b* and 8*b*, and the reversing unit 6 is positioned between the cleaning units 7*a* and 8*a*. Each of the reversing units 5, 6 serves to reverse a semiconductor wafer, i.e. turn the semiconductor wafer over.

The polishing units 1*a* and 1*b* are of basically the same specifications, and are located symmetrically with respect to the transfer line. At least one of the polishing units 1*a* and 1*b* constitutes a polishing section. Each of the polishing units 1*a*, 1*b* comprises a turntable 9 with a polishing cloth attached to an upper surface thereof, a top ring head 10 for holding a semiconductor wafer under vacuum and pressing the semiconductor wafer against the polishing cloth on the upper surface of the turntable 9, and a dressing head 11 for dressing the polishing cloth.

Figure 3:
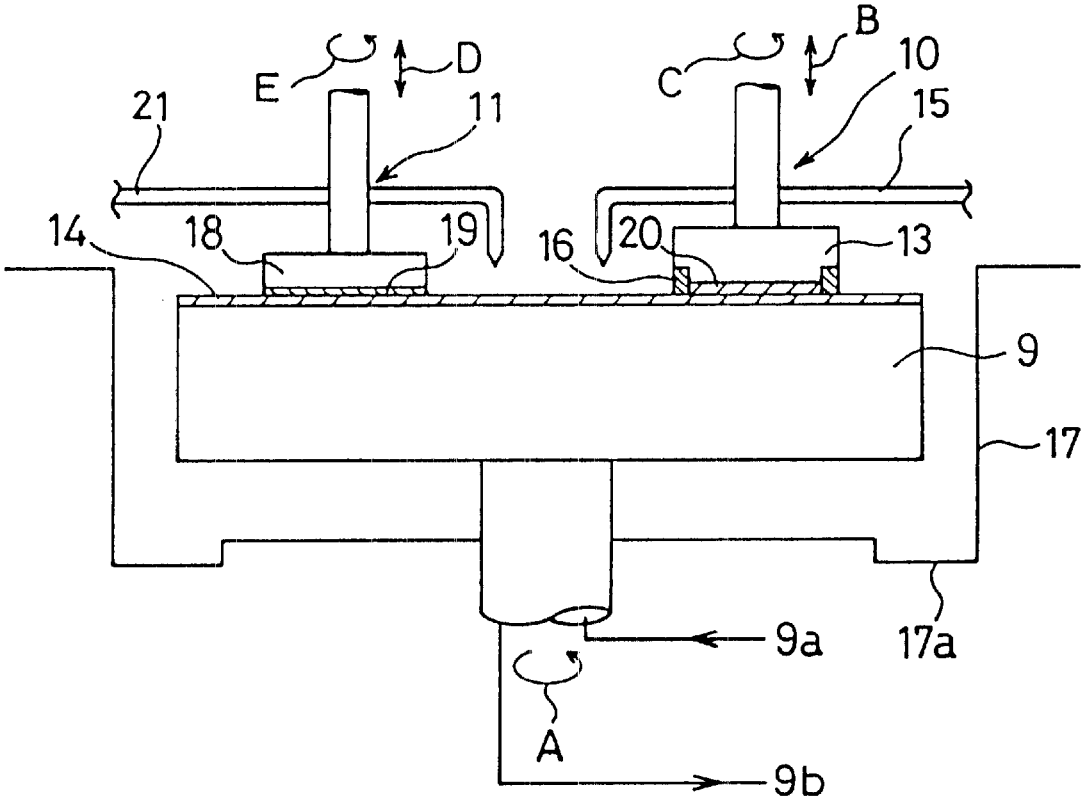
FIG. 3 is, a vertical cross-sectional view of a polishing unit in the polishing apparatus according to embodiment of the present invention.

FIG. 3. shows a detailed structure of the polishing unit 1*a* or 1*b*.

As shown in FIG. 3, the top ring head 10 has a top ring 13 positioned above the turntable 9 for holding a semiconductor wafer 20 and pressing the semiconductor wafer 20 against the turntable 9. The top ring 13 is located in an off-center position with respect to the turntable 9. The turntable 9 is rotatable about its own axis as indicated by the arrow A by a motor (not shown) which is coupled through a shaft comprising the axis to the turntable 9. A polishing cloth 14 constituting a polishing surface is attached to an upper surface of the turntable 9.

When the copper layer formed on the semiconductor wafer is polished, in some cases, heat is generated depending on the slurry, i.e. the polishing liquid. By such heat of reaction, the chemical polishing action is accelerated in the Cu polishing process to cause a change of the polishing rate. In order to avoid this problem, in the present invention, a material having a good thermal conductivity, such as ceramics, is used for the turntable 9 to stabilize the polishing rate.

The ceramics preferably comprises alumina ceramics or silicon carbide (SiC), and such material having a coefficient of thermal conductivity of 0.294 W/ (cm×° C.) (0.07 cal/ (cm×secx° C.)) or higher is desirable. The turntable 9 composed of ceramics is provided with a liquid inlet 9*a* for introducing a liquid into the turntable and a liquid outlet 9*b* for discharging the liquid from the turntable to adjust the temperature of the turntable.

The top ring 13 is coupled to a motor (not shown) and also to a lifting/lowering cylinder (not shown). The top ring 13 is vertically movable and rotatable about its own axis as indicated by the arrows B, C by the motor and the lifting/lowering cylinder. The top ring 13 can therefore press the semiconductor wafer 20 against the polishing cloth 14 under a desired pressure. The semiconductor wafer 20 is attached to a lower surface of the top ring 13 under vacuum or the like. A guide ring 16 is mounted on the outer circumferential edge of the lower surface of the top ring 13 for preventing the semiconductor wafer 20 from being dislodged from the top ring 13.

A polishing liquid supply nozzle 15 is disposed above the turntable 9 for supplying a polishing liquid containing abrasive particles onto the polishing cloth 14 attached to the turntable 9. A frame 17 is disposed around the turntable 9 for collecting the polishing liquid and water which are discharged from the turntable 9. The frame 17 has a gutter 17*a* formed at a lower portion thereof for draining the polishing liquid and water that has been discharged from the turntable 9.

The dressing head 11 has a dressing member 18 for dressing the polishing cloth 14. The dressing member 18 is positioned above the turntable 9 in diametrically opposite relation to the top ring 13. The polishing cloth 14 is supplied with a dressing liquid such as water from a dressing liquid supply nozzle 21 extending over the turntable 9. The dressing member 18 is coupled to a motor (not shown) and also to a lifting/lowering cylinder (not shown). The dressing member 18 is vertically movable and rotatable about its own axis as indicated by the arrows D, E by the motor and the lifting/lowering cylinder.

The dressing member 18 is of a disk shape having substantially the same diameter as the top ring 13 and has a lower surface to which a dressing tool 19 is attached. The polishing liquid supply nozzle 15 and the dressing liquid supply nozzle 21 extend to respective given positions near a rotation center of the turntable 9, and supply the polishing liquid, and the dressing liquid, such as pure water, respectively.

The polishing unit 1*a* or 1*b* operates as follows:

The semiconductor wafer 20 is held on the lower surface of the top ring 13, and pressed against the polishing cloth 14 on the upper surface of the turntable 9. The turntable 9 and the top ring 13 are rotated relatively to each other for bringing the lower surface of the semiconductor wafer 20 into sliding contact with the polishing cloth 14. At this time, the polishing liquid is supplied from the polishing liquid nozzle 15 to the polishing cloth 14. The lower surface of the semiconductor wafer 20 is now polished by a combination of a mechanical polishing action of abrasive particles in the polishing liquid and a chemical polishing action of an alkaline solution in the polishing liquid. The polishing liquid which has been applied to polish the semiconductor wafer 20 is scattered outwardly off of the turntable 9 into the frame 17 under centrifugal forces caused by the rotation of the turntable 9; and collected by the gutter 17*a* in the lower portion of the frame 17. The polishing process comes to an end when the semiconductor wafer 20 is polished to a predetermined thickness of a surface layer thereof. When the polishing process is finished, the polishing properties of the polishing cloth 14 is changed and the polishing performance of the polishing cloth 14 deteriorates. Therefore, the polishing cloth 14 is dressed to restore its polishing properties with the dressing tool 19.

As shown in FIG. 1, each of the polishing units 1*a*, 1*b* also has a pusher 12 positioned near the transfer line 3 for transferring a semiconductor wafer 20 to and receiving a semiconductor wafer 20 from the top ring 13. The top ring 13 is swingable in a horizontal plane, and the pusher 12 is vertically movable.

Figure 4:
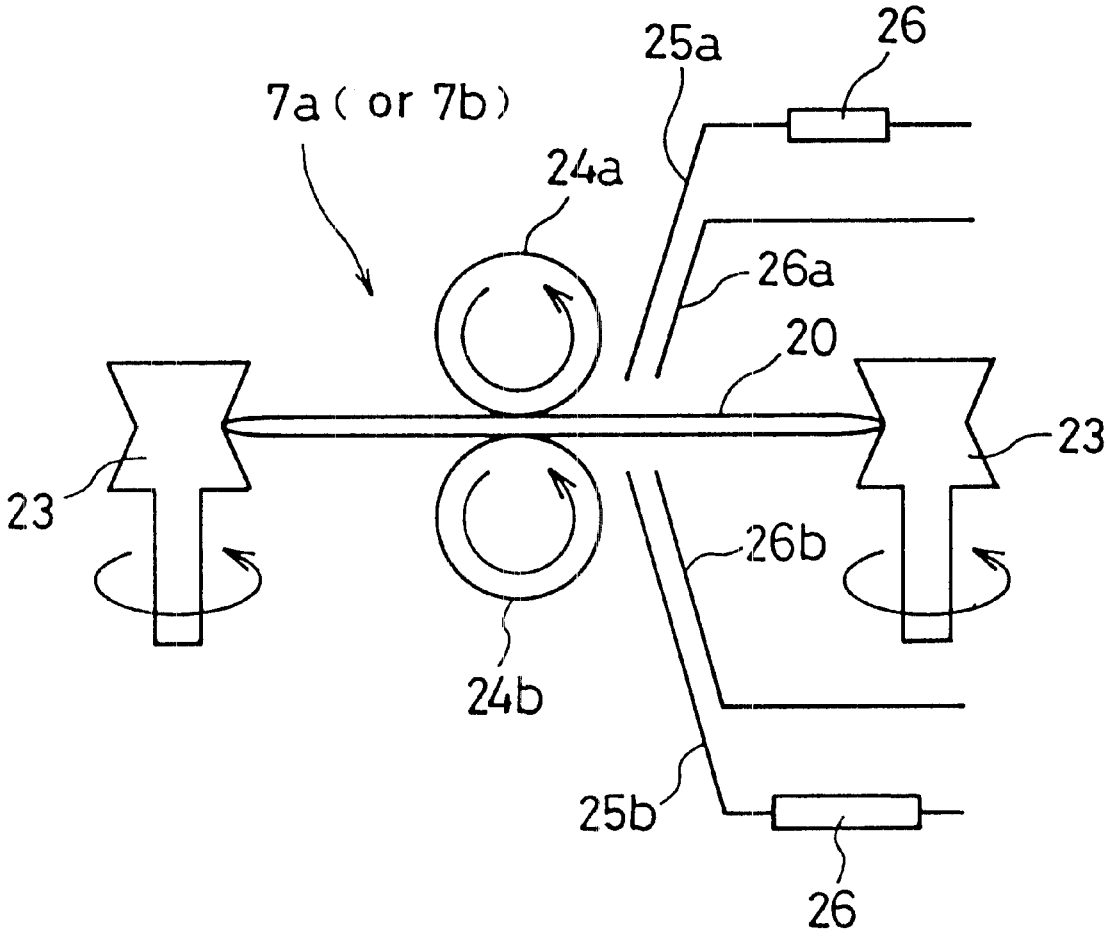
FIG. 4 is a schematic side view of a cleaning unit in the polishing apparatus according to the embodiment of the present invention.

FIG. 4 is a schematic side view showing the structure of the cleaning units 7*a*, 7*b*. As shown in FIG. 4, each of the cleaning units 7*a* and 7*b* comprises a plurality of rollers 23 for holding the peripheral edge of the semiconductor wafer 20 and rotating the semiconductor wafer 20 in a horizontal plane, PVA (polyvinyl alcohol) sponge cleaning members 24*a*, 24*b* having a cylindrical shape for contacting and scrubbing the front and back surfaces of the semiconductor wafer 20, electrolyzed water supply nozzles 25*a*, 25*b* disposed above and below the semiconductor wafer 20, and DHF supply nozzles 26*a*, 26*b* disposed above and below the semiconductor wafer 20. An ultrasonic transducer 26 is provided in each of the lines of the electrolyzed water supply nozzles 25*a*, 25*b*. The electrolyzed water supply nozzles 25*a*, 25*b* supply anode electrolyzed water to the semiconductor wafer, and the DHF supply nozzles 26*a*, 26*b* supply DHF (diluted hydrofluoric acid) to the semiconductor wafer. At least one of the electrolyzed water supply nozzles 25*a*, 25*b* constitutes an electrolyzed water supply device, and at least one of the DHF supply nozzles 26*a*, 26*b* constitutes a supply device for supplying diluted hydrofluoric acid. The ultrasonic transducer 26 imparts ultrasonic vibrations to the anode electrolyzed water to produce megasonic anode electrolyzed water. It is desirable to produce electrolyzed water at a place as close as possible to the ionic wafer supply nozzles 25*a*, 25*b* for thereby lengthening life of the electrolyzed water, i.e., preventing a change of concentration of the electrolyzed water. Further, it is desirable to install a measuring device and/or a controller for monitoring and/or controlling characteristic values such as pH or ion concentration in an electrolyzed water generator.

Each of the cleaning units 8*a*, 8*b* comprises a cleaning machine in which the semiconductor wafer 20 is cleaned by supplying pure water, or anode electrolyzed water and/or megasonic electrolyzed water while holding the peripheral edge of the semiconductor wafer 20 and rotating the semiconductor wafer 20. The cleaning units 8*a*, 8*b* also serve as a drier for drying the semiconductor wafer 20 in a spin-drying process. Thus, the semiconductor wafer 20 which has been polished is primarily cleaned in the cleaning units 7*a*, 7*b*, and the semiconductor wafer 20 which has been primarily-cleaned is secondarily cleaned in the cleaning units 8*a*, 8*b*. The purpose of supplying electrolyzed water to the surface of the substrate in the respective cleaning units and the reversing unit is to form metal-oxide film on the surface of the substrate. Further, the purpose of supplying DHF (diluted hydrofluoric acid) to the surface of the substrate is to dissolve metal-oxide film on the surface of the substrate and remove it therefrom. By supplying electrolyzed water or DHF at desirable places in the polishing apparatus and/or a desirable timing according to its purpose, a the substrate having a uniform and good oxide film in quality can be obtained. At least one of the cleaning units 7*a*, 7*b*, 8*a* and 8*b* constitutes a cleaning section.

Each of the transfer robots 4*a*, 4*b* has an articulated arm mounted on a carriage which is movable along the rail 3. The articulated arm is bendable in a horizontal plane. The articulated arm has, on each of upper and lower portions thereof, two grippers that can act as dry and wet fingers. The transfer robot 4*a* operates to cover a region ranging from the reversing units 5, 6 to the wafer cassettes 2*a*, 2*b*, and the transfer robot 4*b* operates to cover a region ranging from the reversing units 5, 6 to the polishing units 1*a*, 1*b*.

The reversing units 5, 6 are required in the illustrated embodiment because of the wafer cassettes 2*a*, 2*b* which store semiconductor wafers with their surfaces, which are to be polished or have been polished, facing upwardly. However, the reversing units 5, 6 may be dispensed with if semiconductor wafers are stored in the wafer cassettes 2*a*, 2*b* with their surfaces, which are to be polished or have been polished, facing downwardly, and alternatively if the transfer robots 4*a*, 4*b* have a mechanism for reversing semiconductor wafers. In the illustrated embodiment, one of the reversing units 5, 6 serves to reverse a dry semiconductor wafer, and the other of the reversing units 5, 6 serves to reverse a wet semiconductor wafer. Further, the reversing units 5 and 6 may have a nozzle or nozzles for supplying pure water or anode electrolyzed water to the semiconductor wafer 20, when required, depending on the processing.

Next, operation of the polishing apparatus having the above structure will be described below.

The semiconductor wafers 20 to be polished are stored in the wafer cassettes 2*a*, 2*b*, and after all processing conditions are inputted in the polishing apparatus, the polishing apparatus starts an automatic operation.

The processing flow in the automatic operation is as follows:

a) The semiconductor wafers 20 to be polished are 2*b* are placed on the loading/unloading unit.

b) The transfer robot 4*a* takes out the semiconductor wafer 20 from the wafer cassette 2*a* or 2*b* and conveys the semiconductor wafer 20 to the reversing unit 5. The reversing unit 5 reverses the semiconductor wafer 20 to cause a surface to be polished to face downwardly.

c) The transfer robot 4*b* receives the semiconductor wafer 20 from the reversing unit 5, and transfers the semiconductor wafer 20 to the, pusher 12 in the polishing unit 1*a*.

d) In the polishing unit 1*a*, the top ring 13 holds the semiconductor wafer 20 under vacuum, and a primary polishing of the semiconductor wafer 20 is conducted. At this time, only the copper layer formed on the semiconductor wafer 20 is basically polished. It is conceivable that the primary polishing is conducted only for removing the copper layer and the barrier layer is used for a stopper, depending on the kind of slurry, i.e. a polishing liquid. In this case, it is necessary to detect the barrier layer exposed to the outside in situ, i.e. during polishing. Such detection may be conducted by measuring the current of the motor rotating the turntable or the eddy current of a eddy current sensor incorporated in the top ring, or by incorporating an accelerometer or a temperature sensor for detecting the temperature of the turntable.

e) After polishing of the semiconductor wafer 20 is completed, the semiconductor wafer 20 held by the top ring 13 in the polishing unit 1*a* is returned to the pusher 12. Then, the semiconductor 20 is received from the pusher 12 by the transfer robot 4*b* and transferred to the cleaning unit 7*a*.

f) In the cleaning unit 7*a*, the front and back surfaces of the semiconductor wafer 20 are cleaned in a scrubbing cleaning process by the PVA (polyvinyl alcohol) sponge cleaning member 24*a*, 24*b*. In the cleaning unit 7*a*, the scrubbing cleaning process is conducted using only pure water. The front and back surfaces of the semiconductor wafer 20 are simultaneously cleaned to remove the slurry, i.e. the polishing liquid attached to the semiconductor wafer 20 in the primary polishing. At this time, anode electrolyzed water or cathode electrolyzed water may be supplied to the semiconductor wafer 20 by the electrolyzed water supply nozzles 25*a*, 25*b*, depending on the kind of slurry. Further, chemicals such as a surfactant, ammonia, or citric acid may be supplied to the semiconductor wafer 20 by a nozzle or nozzles (not shown).

g) After cleaning of the semiconductor wafer 20 is completed, the semiconductor wafer 20 is received from the cleaning unit 7*a* by the transfer robot 4*b*, and transferred to the pusher 12 in the polishing unit 1*b*.

h) The semiconductor wafer 20 is held by the top ring 13 in the polishing unit 1*b* under vacuum, and a secondary polishing of the semiconductor wafer 20 is carried out in the polishing unit 1*b*. In many cases, the barrier layer is polished in the secondary polishing. This polishing is conducted using the ceramic turntable to stabilize the chemical polishing action. In this case, the end point of polishing is detected by the devices described in the step d).

In the processing flow of the present invention, the surface of the semiconductor wafer 20 is oxidized by the anode electrolyzed water in the cleaning unit which conducts the cleaning process subsequent to the polishing process. Depending on the kind of oxidant; in the secondary polishing process, an oxidant comprising, for example, anode electrolyzed water may be supplied to forcibly oxidize the surface of the copper layer on the semiconductor wafer 20, after stopping the supply of the slurry (polishing liquid). In this case, an electrolyzed water supply nozzle shown in FIG. 4 is provided in the polishing unit 1*b*, which is the polishing section.

i) After the polishing process is completed, the semiconductor wafer 20 is transferred to the pusher 12 by the top ring 13 in the polishing unit 1*b*, and received by the transfer robot 4*b* from the pusher 12. While the semiconductor wafer 20 is standing by above the pusher 12 during transfer to the pusher 12, anode electrolyzed water may be supplied to the semiconductor wafer 20 above the pusher 12.

j) The semiconductor wafer is transferred to the cleaning unit 7*b* by the transfer robot 4*b*, and the front and back surfaces of the semiconductor wafer 20 are cleaned in a scrubbing process by the cleaning unit 7*b*. In this case, first, the slurry (polishing liquid) is removed from the front and back surfaces of the semiconductor wafer 20 by scrubbing the surfaces of the semiconductor wafer 20 with the PVA sponge members 24*a*, 24*b*. At this time, pure water may be supplied, but anode electrolyzed water may be supplied from the outside or inside of each of the PVA sponge members to shorten the cleaning time.

k) In either case in which pure water is supplied or is not supplied, next, anode electrolyzed water is supplied to the front and back surfaces of the semiconductor wafer 20 from the electrolyzed water supply nozzles 25*a*, 25*b* to oxide the surface of the copper layer on the semiconductor wafer 20. At this time, it is desirable to use megasonic anode electrolyzed water produced by imparting ultrasonic vibrations to anode electrolyzed water by the ultraosnic transducer 26 to form copper-oxide film having a good quality.

It is desirable to conduct an oxidation treatment as soon as possible after polishing, and hence the polishing apparatus has a structure such that electrolyzed water may be supplied to the substrate within five minutes after polishing. In this polishing apparatus, anode electrolyzed water may be supplied to both the surfaces of the semiconductor wafer 20.

l) Thereafter, DHF (diluted hydrofluoric acid) is supplied to the semiconductor wafer 20 to remove the. oxide film on the semiconductor wafer 20. By this process, Cu adhesion is equal to or lower than $1\times10^{11}$ atoms/cm$^2$ on the silicon surface of the semiconductor wafer 20.

In the polishing apparatus of the present invention, the cleaning unit 7*b* has not only the electrolyzed water supply nozzles 25*a*, 25*b* but also the DHF supply nozzles 26*a*, 26*b* so that DHF may be supplied to the semiconductor wafer 20 immediately after electrolyzed water is supplied to the semiconductor wafer 20.

m) After removing the oxide film from the semiconductor wafer 20, the semiconductor wafer 20 is received by the transfer robot 4*b* from the cleaning unit 7*b* and transferred to the reversing unit 6. In the reversing unit 6, the semiconductor wafer 20 is reversed.

n) The semiconductor wafer 20 is received by the transfer robot 4*a* from the reversing unit 6, and transferred to the cleaning unit 8*a* or 8*b*.

o) Thereafter, the semiconductor wafer 20 is dried by a spin-drying process, and received by the transfer robot 4*a* from the cleaning unit 8*a* or 8*b* and then returned to the wafer cassette 2*a* or 2*b*.

In the above system, the copper layer on the substrate is polished in a two-stage polishing, i.e. a primary polishing and a secondary polishing. However, from the standpoint of processing efficiency, if a slurry (polishing liquid) by which the copper layer on the substrate may be polished on a single polishing surface on a turntable is developed, then the steps from d) to g) in the steps from a) to o) may be eliminated.

Therefore, the polishing apparatus can be operated by the polishing units 1*a*, 1*b* not only in the above-described serial processing and but also in a parallel processing.

In this case, the change of the processing may be performed not by replacing a software but by operating a changeover switch on the operation board.

A processing flow in the parallel processing is as follows:

One semiconductor wafer 20 is processed in the following route: the wafer cassette 2*a* or 2*b* →the reversing device 5→the polishing unit 1*a*→the cleaning unit 7*a*→the reversing unit 6→the cleaning unit 8*a*→the wafer cassette 2*a* or 2*b*.

The other semiconductor wafer 20 is processed in the following route: the wafer cassette 2*a* or 2*b*→the reversing unit 5→the polishing unit 1*b*→the cleaning unit 7*b*→the reversing unit 6→the cleaning unit 8*b*→the wafer cassette 2*a* or 2*b*.

One of the reversing units 5 and 6 handles a dry semiconductor wafer, and the other of the reversing units 5 and 6 handles a wet semiconductor wafer-in the same way as in the serial processing. The cleaning units disposed on either side of the transfer line may be used in the parallel processing.

In the parallel processing, polishing conditions in the polishing units 1*a*, 1*b* may be the same, and cleaning conditions in the cleaning units 8*a*, 8*b* may be the same. In the cleaning units 8*a*, 8*b*, after the semiconductor wafer 20 is cleaned and spin-dried, it is returned to the wafer cassette 2*a* or 2*b*.

The polishing apparatus is housed in its entirety in a housing having an exhaust duct, and hence substrates to be processed are introduced into the polishing apparatus in a dry condition, and polished and cleaned substrates are removed from the polishing apparatus in a dry condition. Thus, the polishing apparatus may be of a dry-in and dry-out type for introducing therein substrates such as semiconductor wafers having a copper layer in a dry condition and removing therefrom polished and cleaned substrates having a copper wiring circuit in a dry condition.

As described above, according to the present invention, after the copper layer (or film) formed on the substrate is polished, a layer (or film) having a stable quality can be obtained. Further, the substrate which has been polished can be returned to the wafer cassette without being contaminated with copper.

Further, waste liquid generated from electrolyzed water is extremely clean, compared with the case in which other chemicals are used, and therefore special treatment is not required and the load on a waste liquid treatment facility can be reduced.

Although certain preferred embodiments of the present invention have been shown and described in detail, it should be understood that various changes and modifications may be made therein without departing from the scope of the appended claims.

What is claimed is:

1. A polishing method comprising:

polishing a surface of a substrate by holding the substrate and pressing the substrate against a polishing surface of a turntable, the surface of the substrate having a semiconductor device thereon; and cleaning at least a polished surface of the substrate while supplying electrolyzed water to the substrate such that a metal-oxide film is formed on the polished surface of the substrate by said supplying electrolyzed water.

2. A polishing method according to claim 1, wherein the electrolyzed water is supplied to the polished surface and a back surface opposite to the polished surface.

3. A polishing method according to claim 1, further comprising applying ultrasonic vibrations to the electrolyzed water before supplying the electrolyzed water to the substrate.

4. A polishing method according to claim 1, further comprising supplying diluted hydrofluoric acid to the substrate after said cleaning and said supplying electrolyzed water.

5. A polishing method comprising:

conducting a primary polishing of a surface of a substrate by holding the substrate and pressing the substrate against a polishing surface of a turntable, the surface of the substrate having a semiconductor device thereon;

cleaning at least a polished surface of the substrate while supplying electrolyzed water to the substrate such that a metal-oxide film is formed on the polished surface of the substrate by said supplying electrolyzed water; and conducting a secondary polishing of the polished surface of the substrate by holding the substrate and pressing the substrate against another polishing surface of another turntable.

6. A polishing method according to claim 5, wherein the electrolyzed water comprises anode electrolyzed water.

7. A polishing method according to claim 5, further comprising supplying electrolyzed water to the substrate which has been secondarily polished while the substrate is standing by for a subsequent operation.

8. A polishing method according to claim 5, further comprising cleaning the substrate which has been secondarily polished in a scrubbing cleaning process.

9. A polishing method according to claim 5, further comprising cleaning the substrate which has been secondarily polished by supplying electrolyzed water.

10. A polishing method according to claim 9, wherein the said electrolyzed water comprises anode electrolyzed water.

11. A polishing method according to claim 9, further comprising applying ultrasonic vibrations to the electrolyzed water before supplying the electrolyzed water to the substrate.

12. A polishing method according to claim 5, further comprising:

cleaning the substrate which has been secondarily polished and then drying the cleaned substrate; and transferring the cleaned and dried substrate to a cassette.

13. A polishing method comprising:

polishing a surface of a substrate by holding the substrate and pressing the substrate against a polishing surface of a turntable, the surface of the substrate having a semiconductor device thereon;

supplying electrolyzed water to a polished surface of the substrate such that a metal-oxide film is formed on the polished surface of the substrate by said supplying electrolyzed water; and supplying diluted hydrofluoric acid to the substrate after said supplying electrolyzed water.

* * * * *

UNITED STATES PATENT AND TRADEMARK OFFICE

CERTIFICATE OF CORRECTION

PATENT NO. : 6,667,238 B1
DATED : December 23, 2003
INVENTOR(S) : Nori Kimura et al.

It is certified that error appears in the above-identified patent and that said Letters Patent is hereby corrected as shown below:

Column 10,
Line 34, in the second line of the claim, please delete "said".

Signed and Sealed this

Fifteenth Day of June, 2004

JON W. DUDAS
*Acting Director of the United States Patent and Trademark Office*